US010852064B2

(12) United States Patent
Fourie

(10) Patent No.: US 10,852,064 B2
(45) Date of Patent: Dec. 1, 2020

(54) CHANNEL TYPE INDUCTION FURNACE

(71) Applicant: ENVIROSTEEL INC, Blacksburg, VA (US)

(72) Inventor: Louis Johannes Fourie, Randburg (ZA)

(73) Assignee: ENVIROSTEEL INC, Blacksburg, VA (US)

( * ) Notice: Subject to any disclaimer, the term of this patent is extended or adjusted under 35 U.S.C. 154(b) by 168 days.

(21) Appl. No.: 15/743,216

(22) PCT Filed: Jul. 15, 2016

(86) PCT No.: PCT/IB2016/054249
§ 371 (c)(1),
(2) Date: Jan. 9, 2018

(87) PCT Pub. No.: WO2017/009811
PCT Pub. Date: Jan. 19, 2017

(65) Prior Publication Data

US 2018/0195800 A1 Jul. 12, 2018

(30) Foreign Application Priority Data

Jul. 15, 2015 (ZA) ..... 2015/05066

(51) Int. Cl.
*H05B 6/16* (2006.01)
*F27B 14/06* (2006.01)
(Continued)

(52) U.S. Cl.
CPC ..... *F27B 14/065* (2013.01); *F27B 14/061* (2013.01); *F27B 14/08* (2013.01);
(Continued)

(58) Field of Classification Search
CPC ..... F27B 14/061; F27B 14/065; F27B 14/08; F27B 14/0806; F27B 14/14; F27B 14/20;
(Continued)

(56) References Cited

U.S. PATENT DOCUMENTS 4,170,713 A 10/1979 Butseniex et al.
2003/0103546 A1 6/2003 Fourie
2013/0336354 A1* 12/2013 Fourie ..... F27B 14/065 373/142

FOREIGN PATENT DOCUMENTS

WO WO 03/059011 A1 * 7/2003 ..... H05B 6/20
WO 2012117355 A1 9/2012
(Continued)

OTHER PUBLICATIONS

International Search Report and Written Opinion for International Application No. PCT/IB2016/054249 dated Sep. 27, 2016.

*Primary Examiner* — Hung D Nguyen
(74) *Attorney, Agent, or Firm* — Dorsey & Whitney LLP

(57) ABSTRACT

A channel type induction furnace with a furnace floor that is inclined downwards from an operative rear of the furnace hearth towards an opposing operative front of the hearth, with a wall at the front comprising a bottom section and a top section, with the bottom section extending further into the hearth than the top section, and the bottom section terminating in an upper edge in abutment with the top section, with a down-passage to an induction heater, located proximate the front wall, having an inlet in the floor at a location proximate the base of the front wall and up passage(s) having an outlet in the floor at a location in abutment with the base of the bottom section and with the bottom section being provided with a vertical slot extending upwards above the or each up-passage through it and opening onto the upper edge of the bottom section.

16 Claims, 10 Drawing Sheets

(51) Int. Cl.

| | |
|---|---|
| ***F27D 11/06*** | (2006.01) |
| ***F27D 1/06*** | (2006.01) |
| ***F27D 1/04*** | (2006.01) |
| ***F27B 14/08*** | (2006.01) |
| ***F27B 14/14*** | (2006.01) |

(52) U.S. Cl.
CPC ..... *F27B 14/0806* (2013.01); *F27B 14/14* (2013.01); *F27D 1/04* (2013.01); *F27D 1/06* (2013.01); *F27D 11/06* (2013.01)

(58) Field of Classification Search
CPC ... F27D 11/06; F27D 1/04; F27D 1/06; F27D 19/00; F27D 21/0028; H05B 6/20
USPC ..... 373/138, 159–165
See application file for complete search history.

(56) References Cited

FOREIGN PATENT DOCUMENTS

| | | |
|---|---|---|
| WO | 2015044878 | 4/2015 |
| WO | WO 2015/068132 A1 * | 5/2015 |

* cited by examiner

CHANNEL TYPE INDUCTION FURNACE

FIELD OF THE INVENTION

This invention relates to channel type induction furnaces used in the melting or smelting of metals and particularly to induction furnaces used in smelting particulate materials floating on the surface of the metal and slag.

BACKGROUND TO THE INVENTION

Conventional channel induction type furnaces that are fed with particulate material which float on the molten metal surface are designed with relatively deep metal baths. This is so because particulate material floating on the slag layer on top of a bath of molten metal is a poor heat sink which leads to higher metal temperatures and recirculation of heated metal back into the channel heater. This results in overheating of the molten metal and damage to the refractory material lining, if the furnace is designed to operate with a shallow metal bath. A shallow bath also results in relatively cold areas where the melting rate is relatively much slower than in the area directly above the channel heater.

On the other hand a deep metal bath has the disadvantage that more metal must be kept in the furnace, leading to greater heat losses than when a shallow metal bath is used and it results in higher process inventory, compared to operating the furnace with a shallow metal bath. Metal losses, damage to equipment and danger to personnel in the event of a metal leak is also higher when using a deep metal bath.

Further, in an induction furnace with a deep metal bath strong convection currents are set up in the furnace during operation thereof. This results in unstable rapid melting of particulate materials in some areas while in other areas less or even no melting occurs. It has been found that in operation the melting of particulate materials with a deep metal bath leads to areas of melting migration, in other words the areas where melting occurs move around in the furnace, resulting in unstable flow and unstable melting conditions.

An attempt to overcome the above mentioned problems involved the invention described in PCT patent application no PCT/IB2012/050938, by the same applicant. This presented a double loop channel type induction furnace which included a plateau extending above the furnace floor into which a trench is formed. The plateau is provided with throat passages communicating with the induction heater, and with these passages being in fluid communication with the induction heater channels to distribute heated liquid metal into the trench for distribution along the top of the plateau.

A practical problem with the furnace of patent PCT/IB2012/050938 is the construction of the plateau and the trench which need to be fixed to a side wall between opposing end walls of the furnace. The plateau has to be constructed of heat resistant, liquid metal resistant, and slag resistant material—in other words a refractory material. Since the plateau is necessarily submerged and not directly held down by the wall refractory material, metal penetration inevitably leads to distortion of bricks and ultimately destruction of the plateau.

Another practical difficulty is that the use of the trench in the furnace necessitates controlling the depth of liquid metal in the furnace above the trench to ensure optimal distribution of heated metal through the bath. The start-up of the furnace with the plateau and trench is not easy, requiring a relatively large volume of liquid metal. Also, although the distribution of heated metal into the liquid bath may be controlled by the depth of the metal bath over the plateau, this also means that unwanted fluctuations in the metal bath may negatively influence the distribution of heated metal in the liquid bath.

A further problem appears when a furnace is constructed with a long bath. Each induction heater has a limited reach, and this is defined by the distance between the outlets of the passages which transport heated metal to the hearth. When a longer furnace is desired, which equates to a greater production capacity, more powerful induction heaters have to be installed, resulting in less controllable distribution of the heated metal from the inductors.

A further problem with iron making furnaces relate to the interaction between slag and metal. Manual labour and robotics are normally used to separate slag and metal, in an attempt to tap metal free from slag contamination.

Of further concern here is also the entrapment of metal droplets in slag, which reduces the metal yield from the ore. A further problem relating to slag and metal interaction is that when the slag melting point is much higher than the metal melting point, the slag remains close to its melting point—which means the slag is too cold to allow easy flow over long distances without forming thick slag skulls.

In addition to the above problems, in the steelmaking industry liquid iron from any one of a number of iron manufacturing processes is traditionally tapped into ladles (mostly so-called torpedo cars or bottle cars), transported to a steelmaking shop and transferred to a so called charging ladle for charging a steelmaking vessel.

A batch of steel is made by addition of fluxes and by blowing gaseous oxygen onto or through the metal. At the "end point" of the blow samples are taken and if required a "re-blow" is performed and the required ferroalloys prepared for the steel tapping operation. The steel and ferroalloys are charged to the casting ladle, taking care not to transfer steelmaking slag with the metal into the casting ladle. Any slag that may be transferred to the casting ladle results in unnecessary loss of alloying elements and phosphorous returning from the slag to the metal.

In order to approximate continuous casting, so-called sequence casting is performed, whereby the temperature of the metal in the ladle and the timing of the ladle arriving at the caster must be controlled. Missing a sequence results in the steel to be reprocessed or at least reheated.

Metal from the casting ladle is poured into a tundish from where it flows into the casting mould. Care must be taken to minimize ladle slag from entering the tundish. An excessive amount of slag in the tundish and oxygen dissolved from air contact cause unacceptable non-metallic inclusions in the cast product.

Ladle linings are expensive to maintain because of the alternatively empty and full condition that these experience during conventional steel making processes. Heat is lost especially when the ladle is empty and without a lid, and tapping steel into a ladle that has cooled down results in heat losses from the steel, which may cause casting problems or even missing a casting sequence. Lifting and lowering of full and empty ladles require large overhead cranes that need to be maintained and provided with significant amounts of electrical power. Overhead movement of ladles with liquid metal is extremely dangerous; many people have lost their lives and were injured in the past due to accidents with overhead transport of liquid metal. Many have also lost their lives in accidents while doing maintenance work on these high structures.

During transfer operations large amounts of fugitive emissions are generated in short periods of time (less than 10% of calendar time). This requires large installations of fans, electric motors, bag houses, ducting etc. that are either running unnecessarily or standing idle for most of the time.

There are many costs involved in the use of ladles and the fact that processes need to stop and start, some of which have been mentioned above.

The sequence of processes between the iron producing plant through the steel producing plant and into the casting plant requires a delicate balance to prevent downgrading of steel batches and interruption of the smooth operation of these processes. In most iron-steel-casting plants this delicate balance is upset on a daily basis through unforeseen circumstances, leading to costly interruptions and downgrades of batches of steel.

OBJECTIVE OF THE INVENTION

It is an objective of the invention to provide a channel type induction furnace and a steelmaking apparatus which at least partly overcomes the abovementioned problems.

SUMMARY OF THE INVENTION

In accordance with this invention there is provided a channel type induction furnace comprising a shell lined with refractory material, and having a floor with a wall extending from the floor to form a hearth, at least one induction heater associated with the furnace and communicating with the hearth by means of a throat in the floor, the throat including throat passages comprising a down-passage serving as an inlet to the induction heater and at least one up-passage serving as an outlet from the induction heater, the throat passages being complementary shaped and configured to channels in the induction heater and each passage being in fluid communication with a complimentary shaped and sized channel;

with the furnace floor being inclined downwards from an operative rear of the hearth towards an opposing operative front of the hearth;

with the wall at the front of the hearth comprising a bottom section and a top section to form a front wall, with the front wall bottom section extending further into the hearth than the front wall top section, and the front wall bottom section terminating in an upper edge in abutment with the front wall top section;

with the down-passage having an inlet in the floor at a location proximate the base of the front wall;

with the or each up-passage having an outlet in the floor at a location in abutment with the base of the front wall bottom section and with the front wall bottom section being provided with a vertical slot extending upwards above the or each up-passage through it and opening onto the upper edge of the bottom section, and with the induction heater being located proximate the front wall.

There is still further provided for the floor to be provided with a pit proximate the base of the front wall bottom section and the inlet for the down-passage is located in the pit.

According to a still further feature of the invention there is provided for the wall to be comprised of the front wall, an opposing rear wall forming the rear of the hearth, and two opposing end walls;

with an end wall extending between each of opposing ends of the front wall and the rear wall.

There is still further provided for the furnace to comprise a double loop channel type induction furnace with its throat including a central down-passage serving as an inlet to the induction heater and two up-passages on opposite sides of the central down-passage serving as outlets from the induction heater, and with the two outlets from the up-passages being spaced apart, preferably being an equal distance from the down-passage.

There is also provided for the front wall to be inclined into the hearth, preferably by between about 0° and 10° from the vertical.

There is still further provided for the furnace floor to include a substantially horizontal floor base proximate the front wall bottom section, and preferably for the inlet to the central passage to be located in the floor base.

According to a yet further feature of the invention there is provided for the furnace to include a fore-hearth separate from the furnace hearth, the fore-hearth comprising a shell lined with refractory material, and having a floor with a wall extending from the floor to form the fore-hearth, with the fore-hearth communicating with the induction heater up-passage by means of passages opening into it in its floor, the fore-hearth passages comprising a down-passage serving as an outlet and an up-passage serving as an inlet to the fore-hearth from the or each induction heater up-passage operatively to receive substantially slag-free metal from the induction heater, with the fore-hearth passages being complementary shaped and configured to the channels in the induction heater, and with the fore-hearth including a liquid metal overflow plug.

There is still further provided for the fore-hearth to include a set of fore-hearth passages each comprising a down-passage serving as an outlet and an up-passage serving as an inlet to the fore-hearth, with each set of fore-hearth passages being in fluid communication with an induction heater up-passage.

According to a further aspect of the invention there is provided for the furnace to include an elongate fore-hearth separate from and extending away from the furnace hearth, the fore-hearth comprising a shell lined with refractory material, and having a floor with a wall extending from the floor to form the fore-hearth, with the fore-hearth communicating with the induction heater up-passage by means of at least one passage opening into it in its floor at a location distal from the furnace hearth, with the fore-hearth communicating with the furnace hearth by means of a portal extending through the furnace front wall, preferably above the upper edge of the front wall bottom section, with the fore-hearth including a slag outlet, preferably an overflow outlet, at a point distal from the furnace hearth, operatively for heated metal to flow into the fore-hearth at the inlet distal from the furnace hearth and from the fore-hearth into the furnace through the portal, and for slag to flow from the furnace hearth into the fore-hearth through the portal counter current with the heated liquid metal, to allow metal droplets contained in the slag to pass through the slag into the flow of heated metal beneath the slag, and for slag to be removed from the fore-hearth through the slag outlet.

According to a yet further aspect of the invention there is provided a method of operating a furnace as defined above to produce liquid metal, including the steps of:

preparing a feed material comprising a metallic oxide and a reductant, charging the feed material into the furnace onto the inclined furnace floor proximate a rear wall at an operative rear of the hearth, operatively allowing the feed material to accumulate on the floor and to extend into the liquid metal bath, to undergo carbo-thermic reduction through radiation from heat of combustion of gases and optionally also fuel, preferably in the form of gas, introduced into the free space above the liquid metal bath and feed material, for the feed material to melt and join the liquid metal bath, with the gases originating from heating of the feed material and optionally also from fuel introduced into free space above the liquid metal bath and feed material.

According to a yet further aspect of the invention there is provided steelmaking apparatus comprising an iron furnace, and a refining furnace;

with the iron furnace comprising a channel type induction furnace with inclusion of a fore-hearth as defined above and provided with a liquid iron transfer conduit extending from the iron furnace fore-hearth to the refining furnace, to produce liquid iron from an iron containing feed material, contain the liquid iron as a pool in the iron furnace hearth, and to transfer slag-free liquid iron from the pool to the refining furnace by means of the liquid iron transfer conduit; and with the refining furnace comprising a channel type induction furnace without a fore-hearth as defined above in fluid communication with the iron furnace fore-hearth through the liquid iron transfer conduit to receive liquid iron from the iron furnace fore-hearth, to convert the liquid iron to liquid steel and contain the liquid steel as a pool in a hearth, and to transfer slag-free liquid steel from the liquid steel pool to the alloying container by means of a liquid steel transfer conduit, and the refining furnace being provided with a closable outlet to tap liquid steel from the refining furnace.

There is further provided for the steelmaking apparatus to preferably also include an alloying chamber and a casting machine tundish;

with the alloying chamber being provided with heating means for liquid steel to receive liquid steel from the outlet of the refining furnace and contain and heat the liquid steel as a pool in the alloying chamber, the alloying chamber including means for the addition of alloying elements, and the alloying chamber further being configured to transfer slag-free liquid steel to the tundish by means of a tundish transfer conduit extending from beneath the operative slag level of the alloying chamber to the tundish; and with the tundish being configured to receive liquid steel from the alloying container through the tundish transfer conduit to feed a casting machine operatively associated with the tundish by means of a casting outlet; and with the steelmaking apparatus including control means for the liquid iron and liquid steel levels in the furnaces in the form of one or more of casting speed control for the tundish and at least one liquid iron tap hole from the iron furnace.

There is still further provided for the alloying chamber of the steelmaking apparatus to preferably comprise a channel type induction furnace as defined above, and for the alloying chamber to include stirring means for the liquid steel.

There is also provided for the refining furnace of the steelmaking apparatus to include a charging hole for scrap steel or iron.

These and other features of the invention are described in more detail below.

BRIEF DESCRIPTION OF THE DRAWINGS

Preferred embodiments of the invention are described by way of example only and with reference to the accompanying drawings in which.

DETAILED DESCRIPTION OF THE INVENTION

First Embodiment

Figure 1:
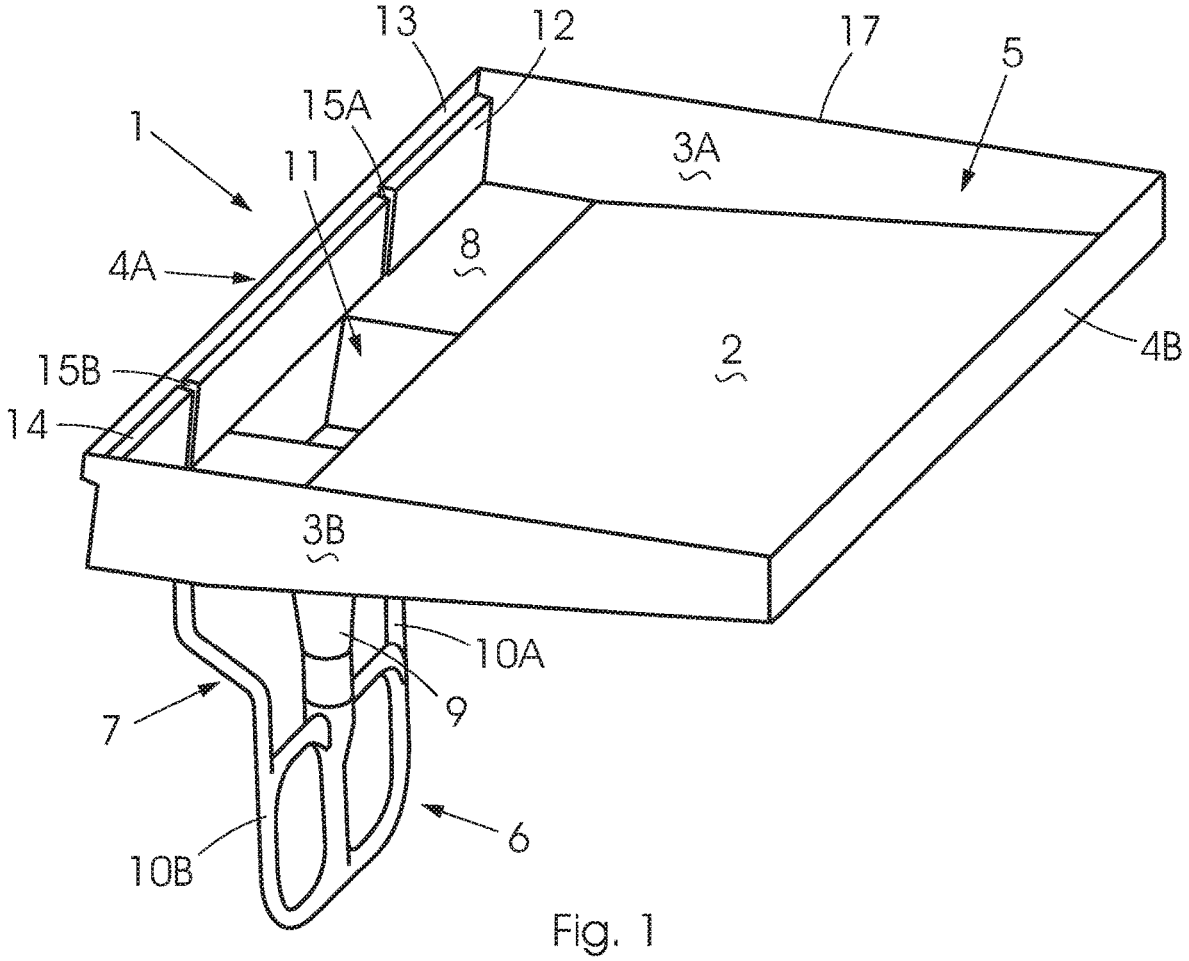
FIG. 1 is an end perspective view of a double loop channel type induction furnace according to a first embodiment of the invention.
Figure 2:
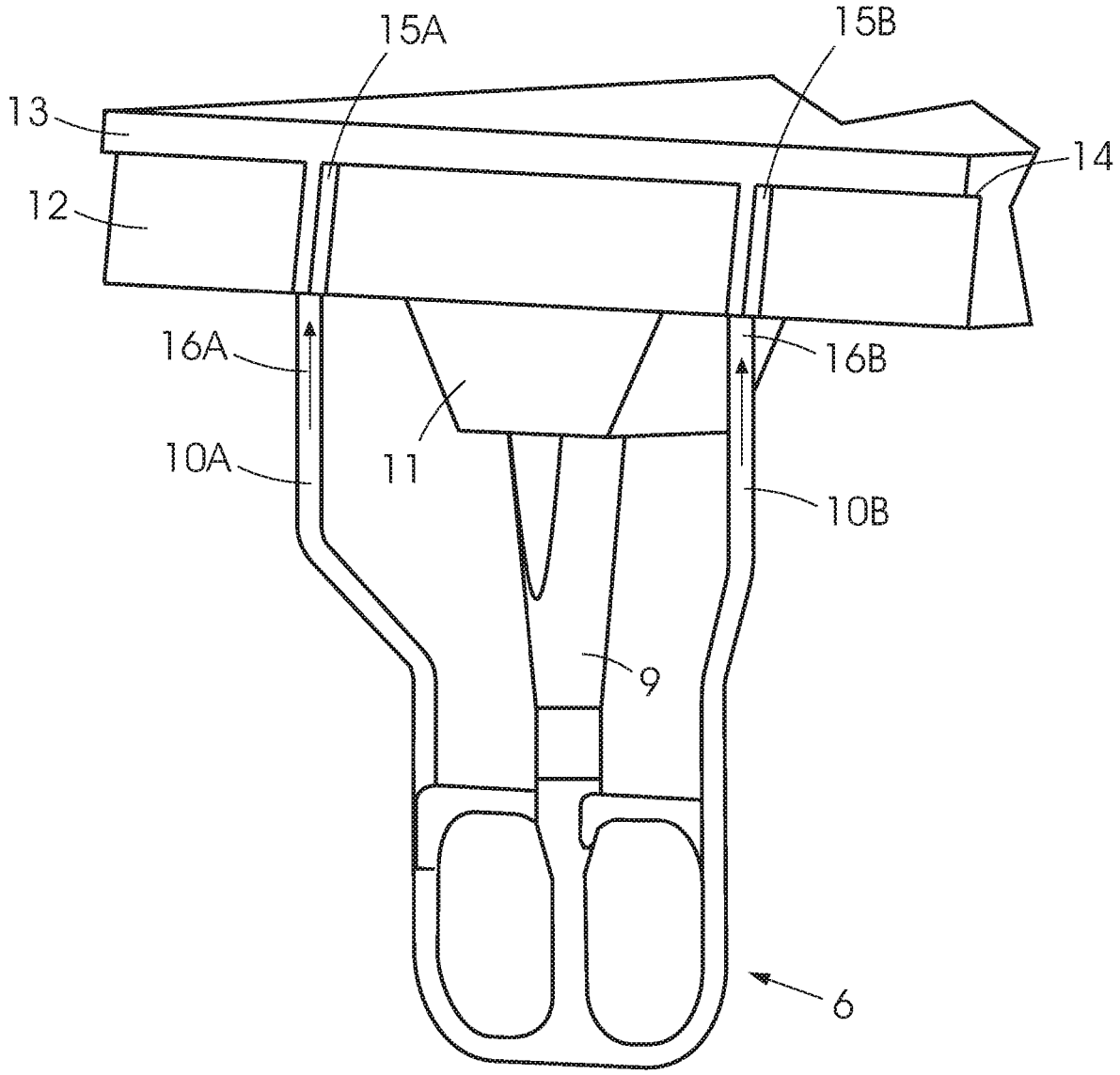
FIG. 2 is a front perspective view of part of the furnace of FIG. 1.

A first embodiment of a furnace (1) according to the invention is shown in FIGS. 1 and 2 without its refractory material and ancillary equipment for the sake of clarity. The furnace (1) comprises an inclined floor (2) with two opposing end walls (3A, 3B), a front wall (4A) and an opposing rear wall (4B). The walls (3, 4) extend from the floor (2) to form a hearth (5). A double loop induction heater (6) is secured to the base of the furnace (1) and communicates with the hearth (5) through a throat (7) in the furnace floor (2).

The furnace floor (2) includes an inclined floor (8), which extends between the front and rear wall (4A, 4B) of the furnace (1). The rear wall (4B) is not shown for the sake of clarity but extends upwards from the rear of the furnace (1), at the rear end (2B) of the floor (2). The inclined floor (2) extends from the rear wall (4B) down to the front wall (4A), and terminates in a substantially horizontal section (8), adjacent the front wall (4A).

The front wall (4A) extends upward from the horizontal section (8) of the floor (2), and is inclined into the hearth (5) at an angle of about 10° from the vertical.

The front wall (4A) is comprised of a bottom section (12) and a top section (13). The bottom section (12) extends further into the hearth (5) than the top section (13), and the bottom section (12) terminates in an upper edge (14) in abutment with the top section (13).

The throat (7) is located below the horizontal section (8) of the floor (2) and includes a central down-passage (9), which serves as an inlet into the induction heater (6). The inlet to the down-passage (9) is located within a recessed portion (11) in the horizontal section (8) of the furnace floor (2).

The throat (7) also includes two side up-passages (10A, 10B) on opposite sides of the central passage (9) which serve as outlets from the induction heater (6). The up-passages (10A, 10B) each has an outlet in the floor at a location in abutment with the base of the front wall bottom section (12). The front wall bottom section (12) is provided with a vertical slot (15A, 15B) extending upwards above each up-passage (10A, 10B) through it and opening onto the upper edge (14) of the bottom section (12).

The outlets of the up-passages (10A, 10B) are located underneath the vertical slots (15A, 15B) in the front wall (4A) whilst the inlet (9) is located in the horizontal section (8) of the floor (2). The outlets (10A, 10B) are thus placed to direct the flow of heated metal upwards in abutment with the front wall (4A), whilst the inlet (9) is located off-set from that to draw metal in from the bottom of the liquid metal bath, and more specifically metal located in the recessed portion (11) of the horizontal section (8) of the floor (2).

In use, liquid metal is heated in the channels of the induction heater (6) through electrical resistance to the flow of electromagnetically induced electrical current in these channels. Cooler metal enters the central channel through the central down-passage (9) drawn from the bottom of the liquid metal bath, while heated metal exits from the two outer channels through the outer throat up-passages (10A, 10B). This is well known technology which requires no additional explanation.

The outlets (10A, 10B) are located in the front wall (4A) to ensure that the heated metal that exits the outlets (10A, 10B) flow upwards in contact with the front wall (4A). The heated metal continues flowing (15) in the vertical slots (15A, 15B) in the front wall (4A) to exit onto the upper edge (14) of the bottom section (12).

The meniscus (17) of the liquid metal bath is operatively maintained above the upper edge (14) of the bottom section (12), which means the heated metal is directed upwards in the slots (15A, 15B) along the front wall (4A) to underneath the meniscus (17). When the relatively diffuse jets (16) impinge on the meniscus (17) from below, flow is spread away from and along the top of the front wall (4A).

By arranging a larger number of smaller inductors along the length of a relatively very long furnace with all their up-passage outlets equidistant from each other, controlled and even melting can be spread over a long distance. The front wall (4A) inward angle influences the degree of diffusion (spreading) and stability of the jets (16) before reaching the meniscus (17).

The inward angle of the front wall (4A) and the use of the slots (15A, 15B) mitigates deflection of the jets (16A, 16B) by circulating metal currents in the bath which would otherwise adversely affects the melting pattern in the hearth. This arrangement has the effect of stable flow patterns with reduced likelihood of heated metal returning to the induction heater (6).

The objective would be to design the furnace to introduce heat at a low intensity (kW/m furnace length) and evenly to ensure even melting of charge material and thereby maximize the opportunity to transfer combustion heat to the top surface of the material to be melted. This is achieved by using smaller induction heaters, each with a better power factor, as opposed to the conventional larger induction heater, making it more economic to operate.

This also makes it possible and economically feasible to construct a larger volume furnace, in which the distance of the end walls is greatly increased. This provides an elongated horizontal section of the floor into which a series of induction heaters is fitted, side-by-side. Each of these induction heaters will then serve a predetermined length of the furnace, typically being about 3 m. The distance between the two outlets of each induction heater is then about 1.5 m, and each outlet serves about 1.5 m in length.

Second Embodiment

Figure 3:
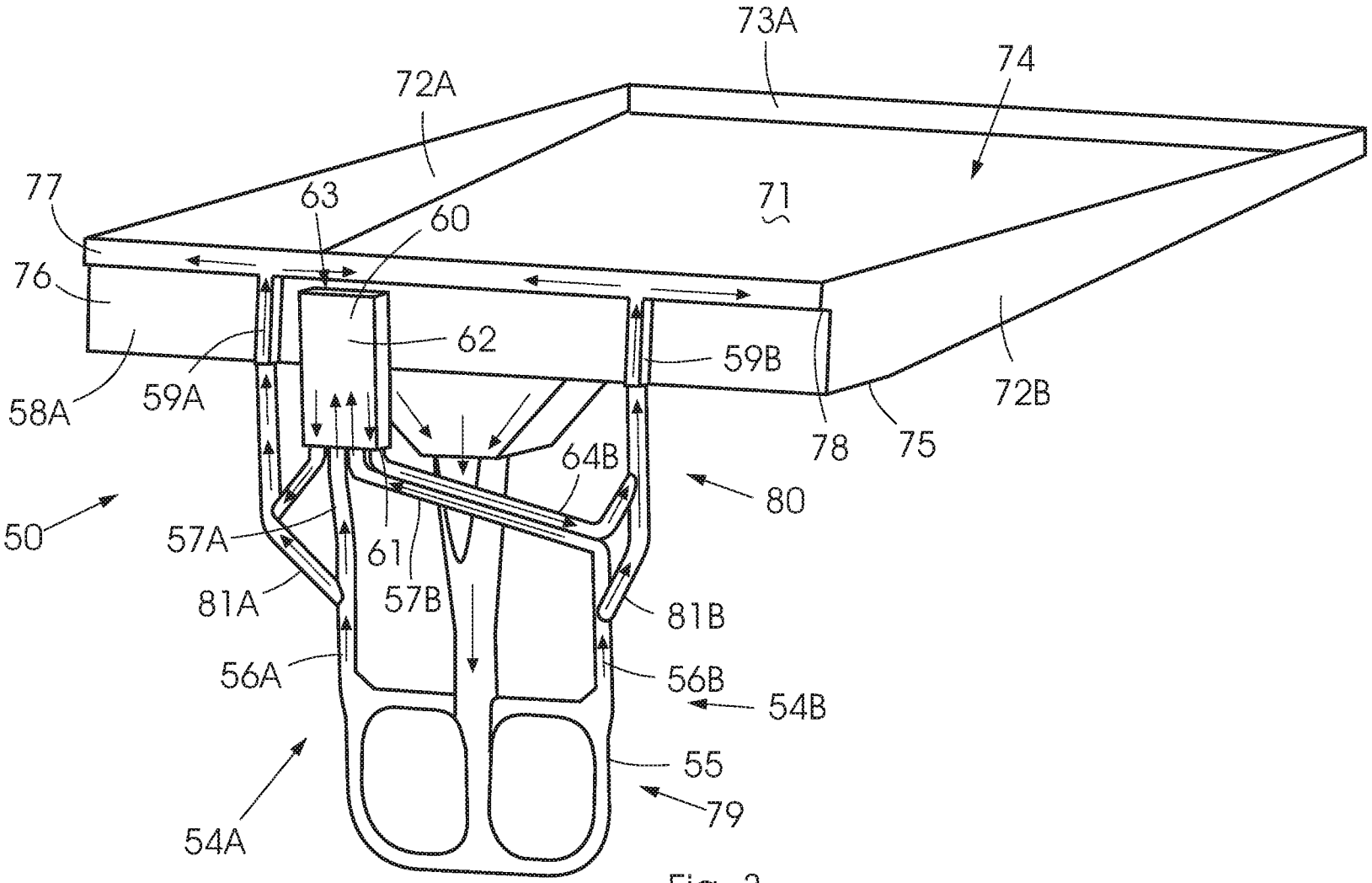
FIG. 3 is a front perspective view of a second embodiment of a furnace according to the invention, which comprises a furnace similar to that of FIG. 1 with the addition of a first embodiment of a fore-hearth.

A second embodiment of a furnace (50) according to the invention is shown in FIG. 3. This furnace (50) is similar to the furnace (1) of the first embodiment shown in FIGS. 1 and 2, with the addition of a first embodiment of a fore-hearth (60). The furnace (50) includes an inclined floor (71), two opposing end walls (72A, 72B), a front wall (73A) and an opposing rear wall (73B). The walls (72, 73) extend from the floor (71) to form a hearth (74). The inclined floor (71) extends from the rear wall (73B) down to the front wall (73A), and terminates in a substantially horizontal section (75), adjacent the front wall (73A).

The front wall (73A) extends upward from the horizontal section (75) of the floor (71), and is inclined into the hearth (74) at an angle of about 10° from the vertical.

The front wall (73A) is comprised of a bottom section (76) and a top section (77). The bottom section (76) extends further into the hearth (74) than the top section (77), and the bottom section (76) terminates in an upper edge (78) in abutment with the top section (77).

The furnace (50) includes a double loop induction heater (79) secured to the base of the furnace (50), which communicates with the hearth (74) through a throat (80) below the horizontal section (75) of the furnace floor (71). The throat (80) includes a central inlet passage (9), which serves as an inlet into the induction heater (79). The inlet to the down passage (53) is located within a recessed portion in the horizontal section (75) of the furnace floor (71).

The throat (80) also includes two spaced-apart outlet passages (54A, 54B), located on opposite sides of the inlet passage (53). Each outlet passage (54) includes a first vertical (56A, 56B) section, that is arranged substantially vertical and is directed substantially parallel with the inlet passage (53). Each first section (56A, 56B) extends into an angled second section (57A, 57B), which is directed upward and away from the furnace (50). These second sections (57A, 57B) of the outlet passages (54A, 54B) each separately opens up in the floor (61) of the fore-hearth (60). The fore-hearth (60) is located adjacent the front wall (58A) of the furnace (50). The fore-hearth (60) is comprised of a floor (61), with walls (62) extending upward around it to form the hearth (63) of the fore-hearth (60).

The fore-hearth (60) is also provided with two outlet passages (64A, 64B) in its floor (61), which extend downwards from the fore-hearth (60) and is each directed to the furnace (50) to curve up from lower than the front wall (58A) of the furnace (50) to each respectively flow into a slot (59A, 59B) formed in the lower section (76) of the front wall (58A), which opens up onto the upper edge (78) of the lower section (76).

The second sections (57A, 57B) of the outlet passage (54A, 54B) from the induction heater (79) each branches into another passage (81A, 81B) before it reaches the fore-hearth (60). These passages (81A, 81B) are each connected to the respective outlet passage (59A, 59B) from the fore-hearth (60) on its end of the furnace (50) and feeds along with such fore-hearth (60) outlet passage (59A, 59B) into the respective slot (59A, 59B) in the lower section (76) of the front wall (58A) of the furnace (50).

In use the hearth (63) of the furnace (50) is filled with liquid metal, which circulates through the induction heater (79) for heating. Cooler metal is drawn into the channel (55) via the central inlet passage (53). Heated metal flows from the channel (55) to the hearth (63) and to the fore-hearth (60) via the outlet passages (54A, 54B).

When the power is switched off at any stage, there is no movement of metal in the passages (53, 54A, 54B). When power is switched on, heat is exchanged between the channel (55) and the metal in the ends of the passages (53, 54A, 54B) where they connect with the channel (55). Since there is a greater volume of metal contained in the larger inlet passage (53), more heat is required to heat metal in the inlet passage (53) than what is required to heat the metal in the smaller outlet passages (54A, 54B). At some stage the metal in the outlet passages (54A, 54B) reaches a higher temperature than the metal in the inlet passage (53). The density of metal generally decreases with an increase in it temperature. The higher density of the metal in the inlet passage (53) causes it to displace metal via the channel (55) loop to the outlet passages (54A, 54B). Initially the flow rate is extremely low, but once it is started, the effect is enhanced by cool metal being drawn into the inlet passage (53), heated in the channel (55) and passed on into the outlet passages (54A, 54B).

By having separate inlet (53) and outlet (54A, 54B) passages it is possible to direct the flow of metal from the outlet passages (54A, 54B). In particular, it is possible to direct the flow of heated metal away from the inlet passage (53) to avoid short-circuiting of metal flow. In a conventional double loop induction heated furnace short-circuiting is possible, and usually expected, when the bath level is low in the hearth (63). This could lead to local overheating with well-known negative effects.

By directing flow of heated metal away from the inlet (53), it is possible even with very low bath levels to avoid short-circuiting.

As indicated above, the heated metal that flows from the induction heater channel (55) is split into two to reach the hearth (63), firstly via the passages (57A, 57B) to the fore-hearth (60) and secondly via the direct passages (81A, 81B) to the hearth (63). The heated metal that flows to the fore-hearth (60) and collects in the fore-hearth (60) up to the same level as in the furnace (50). This is because both the furnace hearth (63) and the fore-heath (60) are connected and at atmospheric pressure, which allows level equalisation to occur. The fore-hearth (60) is provided with a closable overflow in one of its side walls (62) that is used to tap slag-free heated liquid metal from the fore-hearth (60), and thus effectively from the furnace (50). The metal is substantially slag-free because it enters the inlet passage (53) to the induction heater (79) from the bottom of the hearth (63), where the least slag will be present. Slag entrapment in the metal is minimised due to the steady operating conditions in the hearth (63), which avoids violent actions and reactions in the hearth, and allows slag to float to the top of the liquid metal bath in the hearth (63).

The advantage of tapping essentially slag-free liquid metal from the furnace (50) is significant and is self-evident to those skilled in the art.

Third Embodiment

Figure 4:
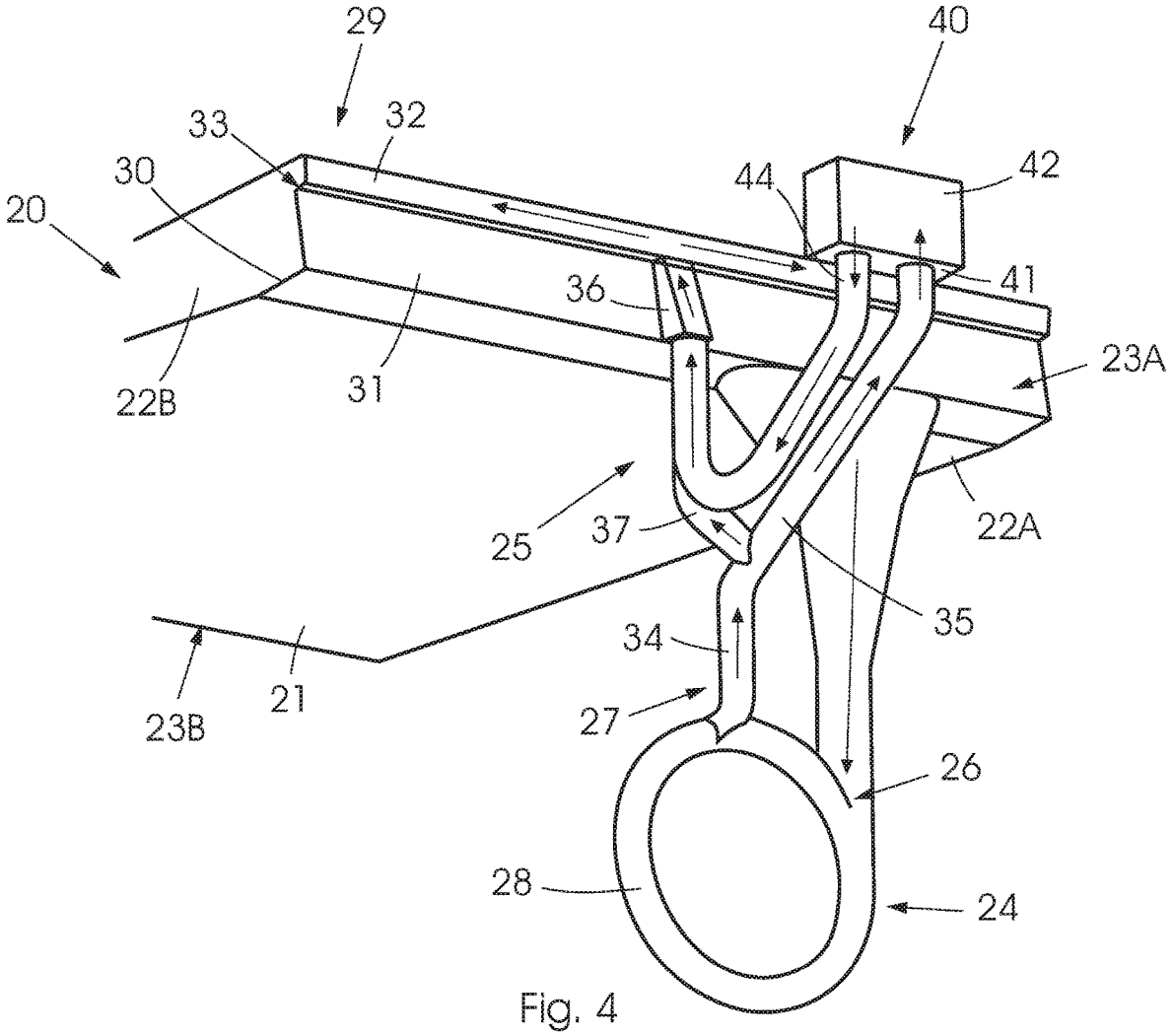
FIG. 4 is a bottom front perspective view of a part of a third embodiment of a furnace according to the invention, which comprises a single loop channel type induction furnace, provided with a similar fore-hearth as that of the furnace in FIG. 3.
Figure 5:
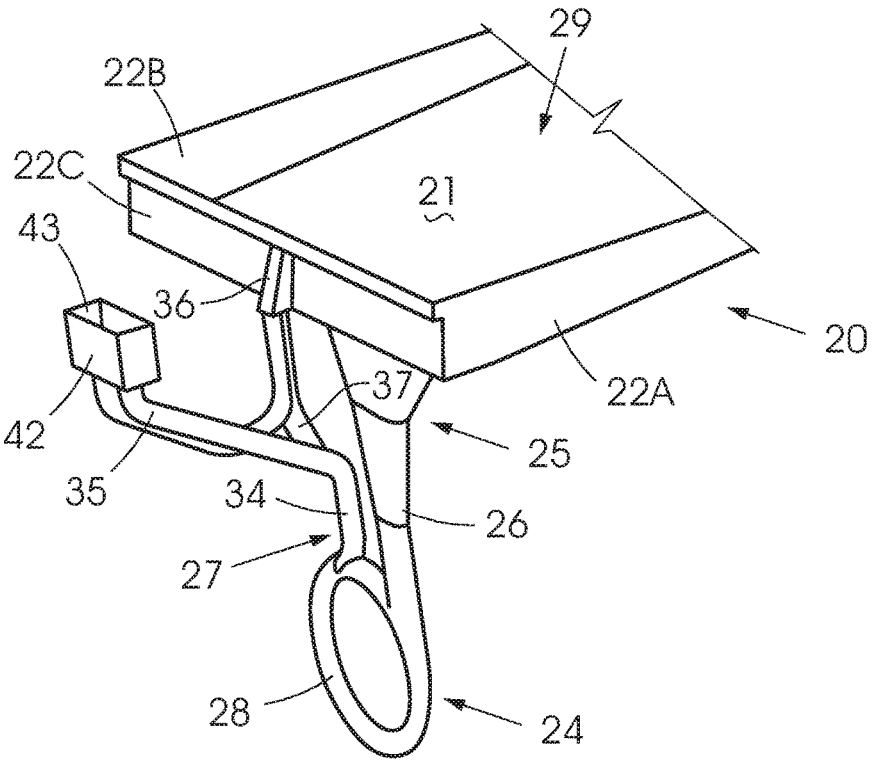
FIG. 5 is a top perspective view of part of the furnace of FIG. 4.

A third embodiment of an induction furnace (20) according to the invention is shown in FIGS. 4 and 5, again shown without its refractory material and ancillary equipment for the sake of clarity. This third embodiment comprises a single loop induction heated furnace (20) that includes a shell lined with refractory material (not shown), and having an inclined floor (21) with two opposing end walls (22A, 22B), a front wall (23A) and an opposing rear wall (23B). The walls extend from the floor (21) to form a hearth (29).

The inclined floor (21) extends from the rear wall (23B) down to the front wall (23A), and terminates in a substantially horizontal section (30), adjacent the front wall (23A).

The front wall (23A) extends upward from the horizontal section (30) of the floor (21), and is inclined into the hearth (29) at an angle of about 10° from the vertical.

The front wall (23A) is comprised of a bottom section (31) and a top section (32). The bottom section (31) extends further into the hearth (29) than the top section (32), and the bottom section (31) terminates in an upper edge (33) in abutment with the top section (32).

The furnace (20) includes at least one single loop channel type induction heater (24) associated with it and this induction heater (24) is in fluid communication with the hearth (29) by means of a throat (25) in the floor (21). The throat (25) is located below the horizontal section (30) of the floor (21).

The throat (25) comprises two throat passages (26, 27) each of which is in communication with the induction heater channel (28). The throat passages (26, 27) include an inlet passage (26) for flow of metal from the hearth (23) to the induction heater channel (28) and an outlet passage (27) for flow of metal from the induction heater channel (28) to the hearth (29), with the inlet passage (26) having a larger cross sectional area than the outlet passage (27).

A person skilled in the art will appreciate that the channel (28) and the portions of the passages (26, 27) that extend below the furnace are formed within a bulk of refractory material. For the sake of clarity, this refractory material below the furnace (20) is not shown in any of the drawings.

As mentioned, the throat comprises two passages, namely the inlet passage (26) and the outlet passage (27). The inlet passage (26) commences at floor level (21) in the hearth and extends substantially vertical down from the floor to the channel (28), to which it is tangentially connected. The outlet passage (27) extends from the channel (28), also tangentially, and terminates in a recessed portion of the lower section of the front wall (31).

It has a first section (34) that is arranged substantially vertical and is directed substantially parallel with the inlet passage (26). The first section (34) extends into an angled second section (35), which is directed upward and away from the furnace (20). This second section (35) of the outlet passage opens up in the floor (41) of a fore-hearth (40), which is located adjacent the front wall (23A) of the furnace (20). The fore-hearth (40) is comprised of a floor (41), with walls (42) extending upward around it to form the hearth (43) of the fore-hearth (40).

The fore-hearth (40) is also provided with an outlet passage (44) in its floor (41), which is extends downwards from the fore-hearth (40) and directed to the furnace to curve up from lower than the front wall (23A) of the furnace (20) to flow into a slot (36) formed in the lower section (31) of the front wall (23A), which opens up onto the upper edge (33) of the lower section (31).

The second section (35) of the outlet passage (27) from the induction heater (28) branches into another passage (37) before it reaches the fore-hearth (40). This passage (37) is connected to the outlet passage (44) from the fore-hearth (40) and feeds along with the fore-hearth (40) outlet passage (44) into the slot (37) in the lower section (31) of the front wall (23A) of the furnace (20).

In use the hearth (29) of the furnace (20) is filled with liquid metal, which circulates through the induction heater (24) for heating. Cooler metal is drawn into the channel (28) via the inlet passage (26). Heated metal flows from the channel (28) to the hearth (29) and to the fore-hearth (40) via the outlet passage (27).

When the power is switched off at any stage, there is no movement of metal in the passages (26, 27). When power is switched on, heat is exchanged between the channel (28) and the metal in the ends of the passages (26, 27) where they connect with the channel (28). Since there is a greater volume of metal contained in the larger inlet passage (26), more heat is required to heat metal in the inlet passage (26) than what is required to heat the metal in the smaller outlet passage (27). At some stage the metal in the outlet passage (27) reaches a higher temperature than the metal in the inlet passage (26). The density of metal generally decreases with an increase in it temperature. The higher density of the metal in the inlet passage (26) causes it to displace metal via the channel (28) loop to the outlet passage (27). Initially the flow rate is extremely low, but once it is started, the effect is enhanced by cool metal being drawn into the inlet passage (26), heated in the channel (28) and passed on into the outlet passage (27).

By having separate inlet (26) and outlet (27) passages it is possible to direct the flow of metal from the outlet passage (27). In particular, it is possible to direct the flow of heated metal away from the inlet passage (26) to avoid short-circuiting of metal flow. In a conventional single loop induction heated furnace short-circuiting is possible, and usually expected, when the bath level is low in the hearth (29). This could lead to local overheating with well-known negative effects.

By directing flow of metal away from the inlet (26), it is possible even with very low bath levels to avoid short-circuiting.

As indicated above, the heated metal that flows from the induction heater channel (28) is split into two to reach the hearth (29), firstly via the passage (35) to the fore-hearth (40) and secondly via the direct passage (37) to the hearth (29). The heated metal that flows to the fore-hearth (40) and collects in the fore-hearth (40) up to the same level as in the furnace (20). This is because both the furnace hearth (29) and the fore-heath (40) are connected and at atmospheric pressure, which allows level equalisation to occur. The fore-hearth (40) is provided with a closable overflow in one of its side walls (42) that is used to tap slag-free heated liquid metal from the fore-hearth (40), and thus effectively from the furnace (20). The metal is substantially slag-free because it enters the inlet passage (26) to the induction heater from the bottom of the hearth (29), where the least slag will be present. Slag entrapment in the metal is minimised due to the steady operating conditions in the hearth (29), which avoids violent actions and reactions in the hearth, and allows slag to float to the top of the liquid metal bath in the hearth (29).

The advantage of tapping essentially slag-free liquid metal from the furnace (20) is significant and is self-evident to those skilled in the art.

Fourth Embodiment

Figure 6:
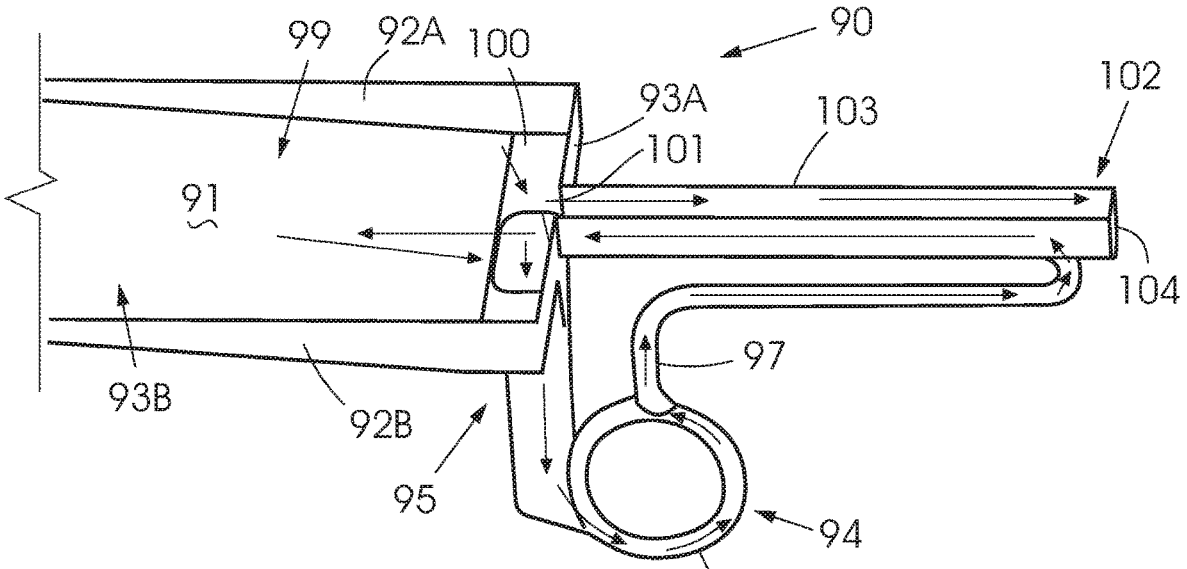
FIG. 6 is an end perspective view of part of a single loop channel type induction furnace according to a fourth embodiment of the invention, provided with a second embodiment of a fore-hearth.

A fourth embodiment of an induction-heated furnace (90) according to the invention is shown in FIG. 6. This furnace (90) is again shown without its refractory material and ancillary equipment for the sake of clarity. This third embodiment (90) comprises a single loop induction heated furnace (90) that includes a shell lined with refractory material (not shown), and having an inclined floor (91) with two opposing end walls (92A, 92B), a front wall (93A) and an opposing rear wall (93B). The walls extend from the floor (91) to form a hearth (99).

The inclined floor (91) extends from the rear wall (93B) down to the front wall (93A), and terminates in a substantially horizontal section (100), adjacent the front wall (93A).

The front wall (93A) extends upward from the horizontal section (100) of the floor (91), and is inclined into the hearth (99) at an angle of about 10° from the vertical.

The front wall (93A) is provided with a portal (101), which extends to a trench (102) bounded by side (103) and end walls (104). The trench (102) extends away from the front wall (93A) of the furnace (90). The trench (102) has a depth that places it bottom below the operative the slag line of the liquid metal bath in the furnace (90). This means that slag can flow into the trench (102) up to its distal end wall (104). The trench (102) is also provided with an overflow in its side (103) or end wall (104), with a height that allows only slag to overflow from it. This provides the furnace with an outlet for slag.

The furnace (90) includes at least one single loop channel type induction heater (94) associated with it and this induction heater (94) is in fluid communication with the hearth (99) by means of a throat (95) in the floor (91). The throat (95) is located below the horizontal section (100) of the floor (91). The throat (95) comprises a single throat passage (96), which is in fluid communication with the induction heater channel (98), which comprises an inlet passage for flow of metal from the hearth (93) to the induction heater channel (98).

The central axis of the induction heater (94) in this embodiment is orientated parallel with the front wall (93A) of the furnace (90), which aligns the circular channel (98) with the inclined floor (91), viewed from the rear wall (93B) to the front wall (93A). This is dissimilar to the embodiment of the single loop induction heater (25) of the furnace (20) shown in FIGS. 4 and 5, In this embodiment, the channel (98) is still located lower than the hearth (99), but it is not located underneath the furnace (90). The inlet passage (96)

extends directly below the furnace (90), at its front wall (93A), and joins the channel (98) tangentially on its side closest to the furnace (90).

The channel (98) is provided with an outlet passage (97) that extends vertically from the top of the channel (98). This outlet passage (97) extends vertically upwards underneath the trench (102), and then turns away from the furnace (90) and extends underneath the trench (102), to turn upwards proximate the distal end (104) of the trench (102), where it extends upwards into the bottom of the trench (102). The outlet passage (97) therefore feeds heated liquid metal into the bottom of the trench (102), at its distal end (104), from where it flows into the hearth through the portal (101) in the front wall (93B) of the furnace (90).

The slag that flows from the hearth (99) into the trench (102), therefore flows counter current with heated liquid metal that flows from the induction heater (94), through the trench (102) into the hearth (99). This allows for metal droplets trapped in the slag to drop out from the slag into the stream of heated liquid metal underneath it, to be moved back into the furnace (90). The furnace (90) is provided with a separate tapping arrangement that takes of liquid metal below the slag line, allowing essentially slag free metal to be tapped from the furnace.

A person skilled in the art will appreciate that the channel (98) and the portions of the passage (96) that extend below the furnace (90) are formed within a bulk of refractory material. For the sake of clarity, this refractory material below the furnace (90) is not shown in any of the drawings.

Fifth Embodiment

Figure 7:
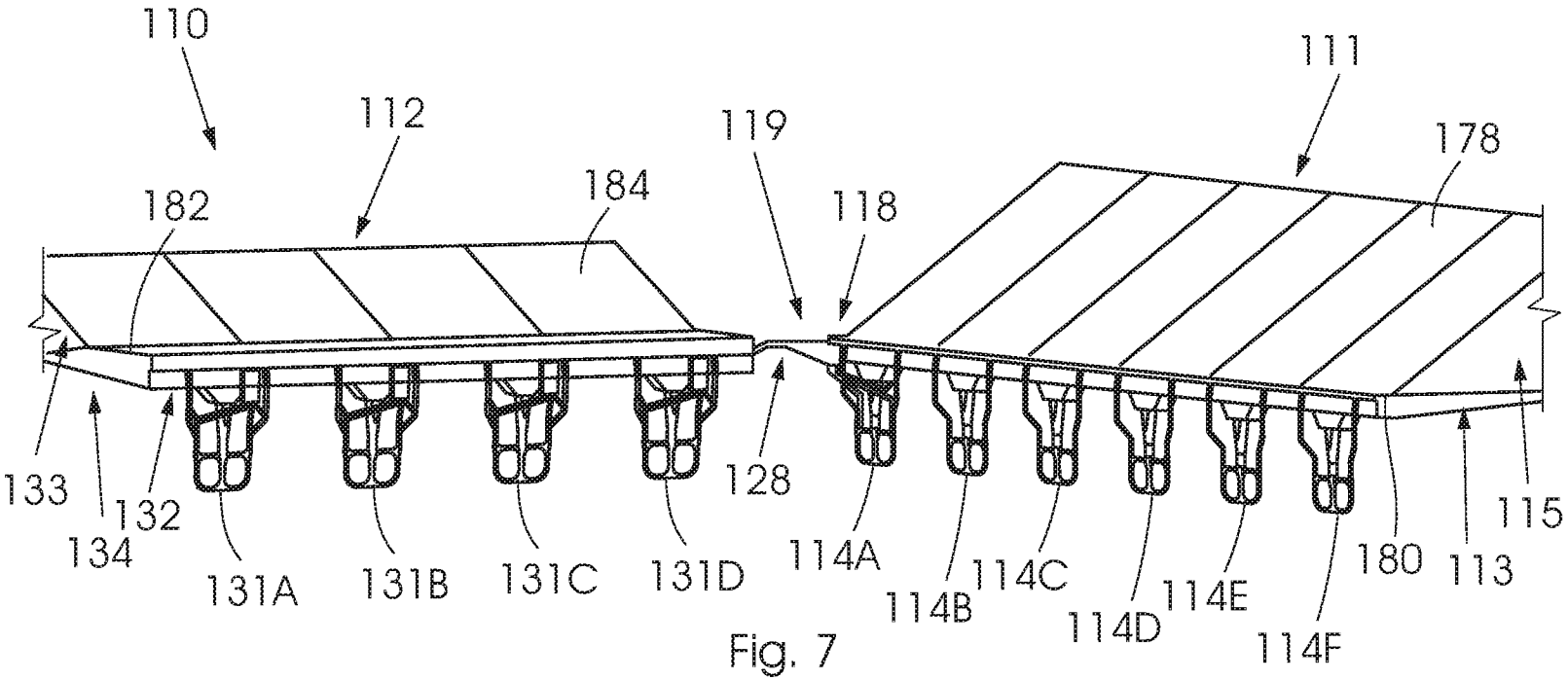
FIG. 7 is a front perspective view of part of an iron making furnace and part of a refining furnace forming part of steelmaking apparatus according to a fifth embodiment of the invention.
Figure 8:
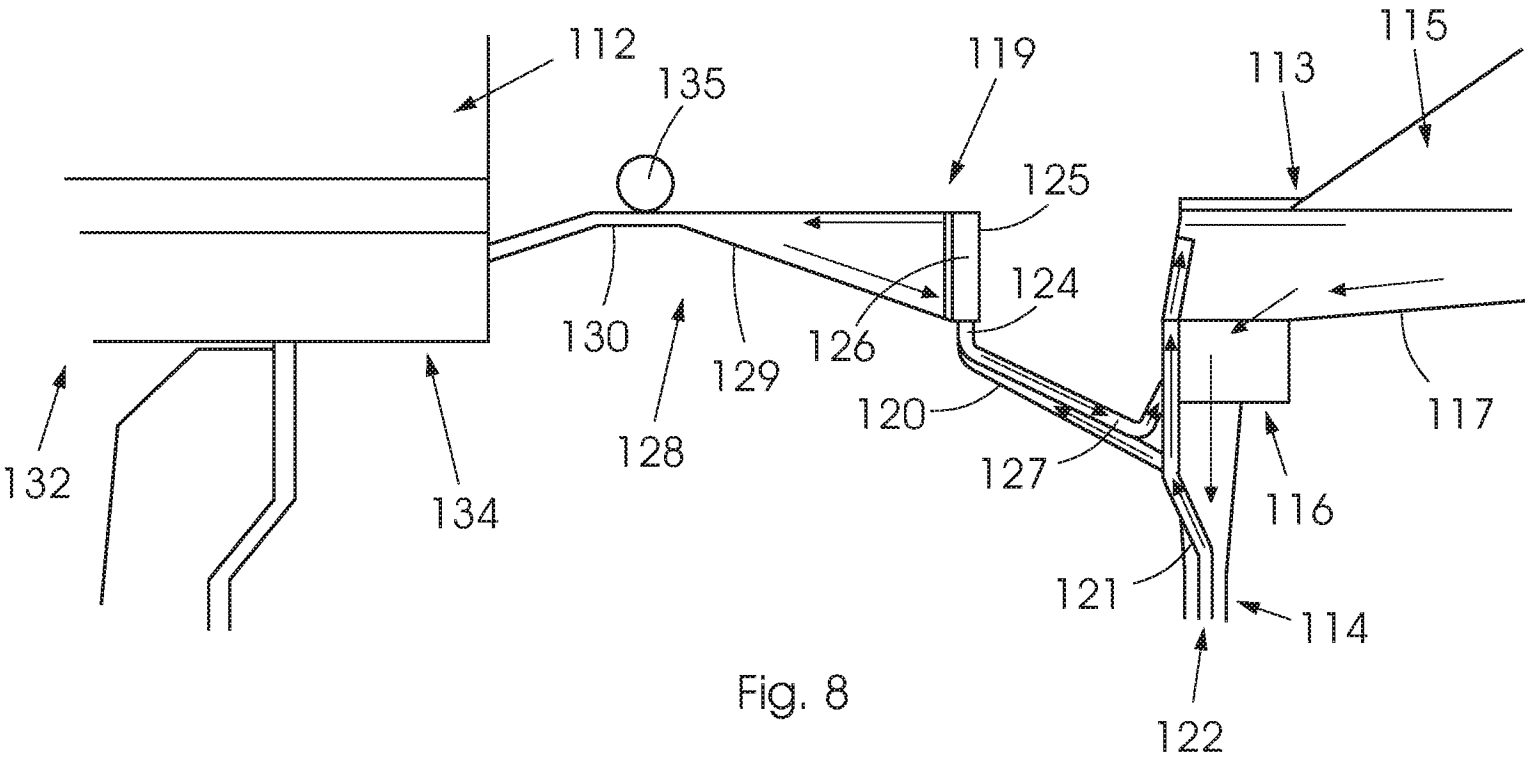
FIG. 8 is a front elevation of part of the steelmaking apparatus of FIG. 7 showing detail of the connection between its iron making furnace and its refining furnace.

A fifth embodiment of the invention is shown in FIG. 7, with detail thereof in FIG. 8. This embodiment of the invention comprises steelmaking apparatus (110) includes an iron making furnace (111) and a refining furnace (112).

The iron making furnace (111) comprises a furnace (113) similar to that of the first embodiment (1) shown in FIGS. 1 and 2, which furnace (113) is provided with a series of 6 spaced apart double loop induction heaters (114A-F) which each communicate with the hearth (115) through a throat (116) in the furnace floor (117).

During operation, and once a pool of liquid iron has been established in the hearth of the furnace (113), liquid iron is produced from the raw material feed of iron ore, coal and fluxes fed into the furnace (113) using, for example, a process as described in any one or more of patent applications PCT/IB2012/050938, PCT/IB2014/064801, and ZA2013/07212 or pig iron and/or scrap is melted in a well-designed furnace.

The iron making furnace (111) includes at one end (118) a fore-hearth (119) extending from the induction heater (114F) located at that end (118). This is similar in arrangement to the second embodiment of the furnace (50) and fore-hearth (60) shown in FIG. 3.

The fore-hearth (119) in this fifth embodiment is comprised of a floor (124), with walls (125) extending upward around it to form the hearth (126) of the fore-hearth (119).

The fore-hearth (119) is in fluid communication with the double loop induction heater (114F) through extensions (120) from the outlet passages (121) from the induction heater channel (122). Each of these separately opens up in the floor (124) of the fore-hearth (119). The fore-hearth (119) is located adjacent the front wall (123) of the furnace (111).

The fore-hearth (119) is also provided with outlet passages (127) in its floor (124), which extend downwards from the fore-hearth (119) and is each directed to the iron-making furnace (111) to curve up from lower than the front wall (123) of the furnace (111) to each respectively flow into a slot (not shown) formed in the lower section (not shown) of the front wall (123), which opens up onto the upper edge (not shown) of the lower section (not shown).

The fore-hearth (119) extends on its side distal from the iron-making furnace (111) into a trough (128) which includes an upwardly angled floor (129), which rises to an overflow passage (130) which connects the fore-hearth (119) with the steel-making furnace (112). The fore-hearth with the overflow passage (130) acts as a so-called tea-pot arrangement to transfer liquid iron to the refining furnace (112), which is a decarburization or refining vessel. The overflow passage (130) is closable by means of a clay plug (135).

In the refining furnace (112) liquid iron is refined by decarburization to produce liquid steel (14). The steelmaking or refining furnace (112) includes a set of four (or any suitable number) double loop electrical induction heaters (131A-D), which each communicate with the hearth (133) through a throat (132) in the furnace floor (134) to circulate and heat the liquid steel.

Heat is required to compensate for endothermic chemical reactions and the cooling effect of cold fluxes and iron oxides and to heat the liquid iron from between about 1300° C. and 1400° C. to steel temperatures between about 1480° C. and 1550° C., depending on the steel grade to be made and casting requirements.

The refining furnace (112) is provided with means (not shown) to remove slag containing phosphorus, sulfur impurities, silica, lime and iron oxide.

From the refining furnace (112), metal is again transferred through another teapot arrangement (not shown) to a casting arrangement, which may include an alloying chamber (not shown), for further chemical refinement and temperature control of the liquid steel before it is cast into a casting mould.

There is no significant loss in elevation between the iron making furnace (111) and the refining furnace (112).

The total surface area of liquid metal in the furnaces (111, 112) is large when compared to conventional technology, resulting in extremely slow changes in elevation during operation when there is a mismatch between melting and casting rates. If the casting rate is lower than the melting rate the level can be controlled by tapping iron from the iron making furnace (111) by means of the additional tapping spouts (not shown) to produce pig iron pigs. If the casting rate cannot be reduced to compensate for insufficient iron production, scrap steel or iron can be added to the refining furnace (112).

Stirring in the iron making furnace (111) and in the refining furnace (112) is taken care of by the channel inductor (114, 131) and throat arrangements (116, 132). Small amounts of slag are formed in the alloying chamber (not shown) which is removed by manual or mechanical skimming (not shown).

Alloying and temperature control is performed using conventional techniques.

Refining is performed by supplying oxygen in the form of iron ore or mill scale. Power required for the reduction of the iron oxide is provided by the channel induction heaters (131). Removal of phosphorous is favoured by lower temperatures, high oxygen potential, basic slag formation and efficient slag to metal contact. All these conditions are ideally reached in the refining furnace (112) without the risk of nitrogen pickup.

Conventional conversion of iron to steel by blowing oxygen gas, results in removal of carbon and silicon from the iron. Further oxygen is required to increase the iron content of the slag, which negatively impacts the yield of steel from a given available iron quantity. To obtain the correct level of iron oxide in the slag in the conventional processes high cost Fe in the liquid iron feed is oxidized. The net effect is that conventionally one can expect a yield (from liquid iron to liquid steel) of about 94%.

In the processing according to the invention the carbon in the melt is effectively replaced by Fe from the ore. Effectively no oxidation of the iron contained in the liquid feed material is performed, and a 106% yield can be reached with the present process. High cost Fe contained in liquid iron is replaced by low cost Fe contained in iron ore and losses minimized. In the present process low cost iron oxide is obtained from the ore, and further carbon present in the liquid iron reduces Fe from the ore or slag thereby increasing the mass of liquid metal.

Decarburization with gaseous oxygen, as used in the conventional processes, results in Fe being vaporized at the point of impact of the oxygen jet with the metal. This is seen as red smoke. The off-gas must be scrubbed with water for removal of the iron oxide, resulting in high water consumption and sludge disposal requirements. In this way the gas can be cleaned and be suitable for recovery as fuel. A maximum volume of off-gas is formed during short periods (less than 25% of calendar time) requiring large ID fans, water pumps, pipes, ducts and electrical motors that consume electric power all the time.

Since the metal and slag levels do not change by more than about 50 mm over time, water cooled copper elements are used to cool a small section of the lining along the slag line. This will ensure extremely long lining lives in all the vessels. So called freeze linings are thus formed.

In this manner and by using this configuration of an iron-making furnace (111) and refining furnace (112) it is possible to produce liquid steel in a very efficient and controlled manner.

The furnaces (111, 112) shown in FIGS. 7 and 8 are not arranged in a line—the two furnaces (111, 112) are angled at about 90° with respect to each other across the intersection formed by the tea-pot arrangement transfer system (128). The 90° is created by taking the transfer system (128) at a right angle of the last induction heater (114F) and introducing it again at a right angle into the side of the refining furnace (112).

Sixth Embodiment

Figure 9:
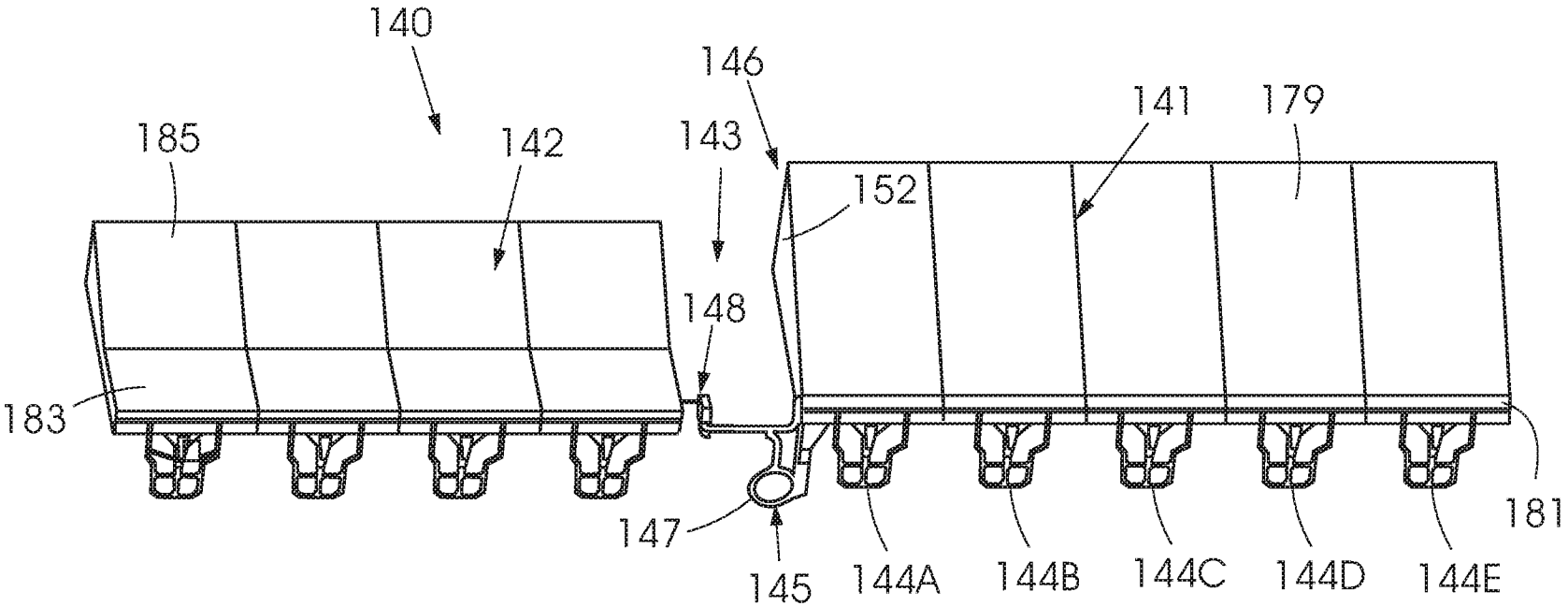
FIG. 9 is a front perspective view of an iron making furnace and a refining furnace forming part of steelmaking apparatus according to a sixth embodiment of the invention.
Figure 10:
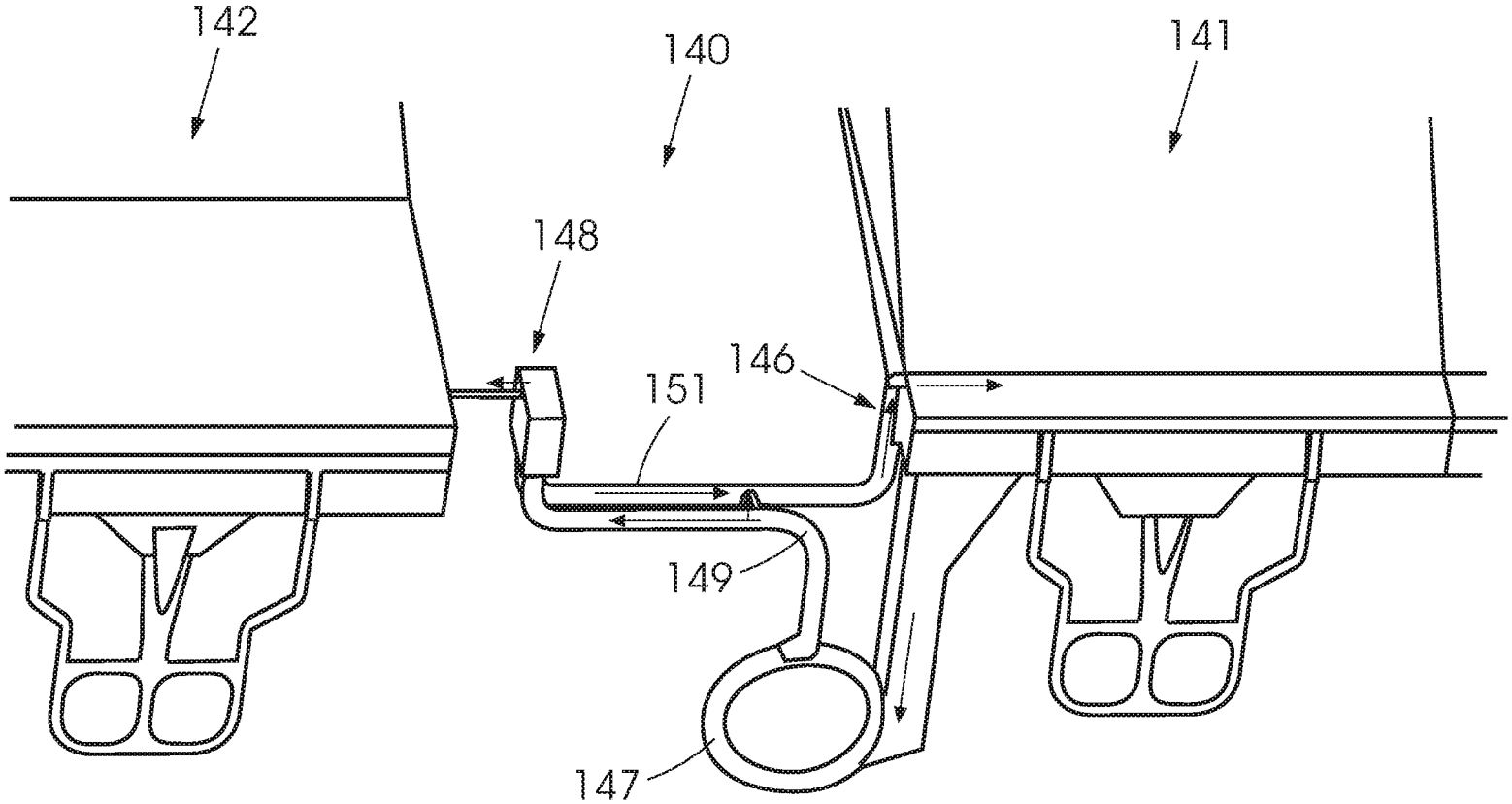
FIG. 10 is top perspective view of part of the steelmaking apparatus of FIG. 9 showing detail of the connection between the iron making furnace and the refining furnace.
Figure 11:
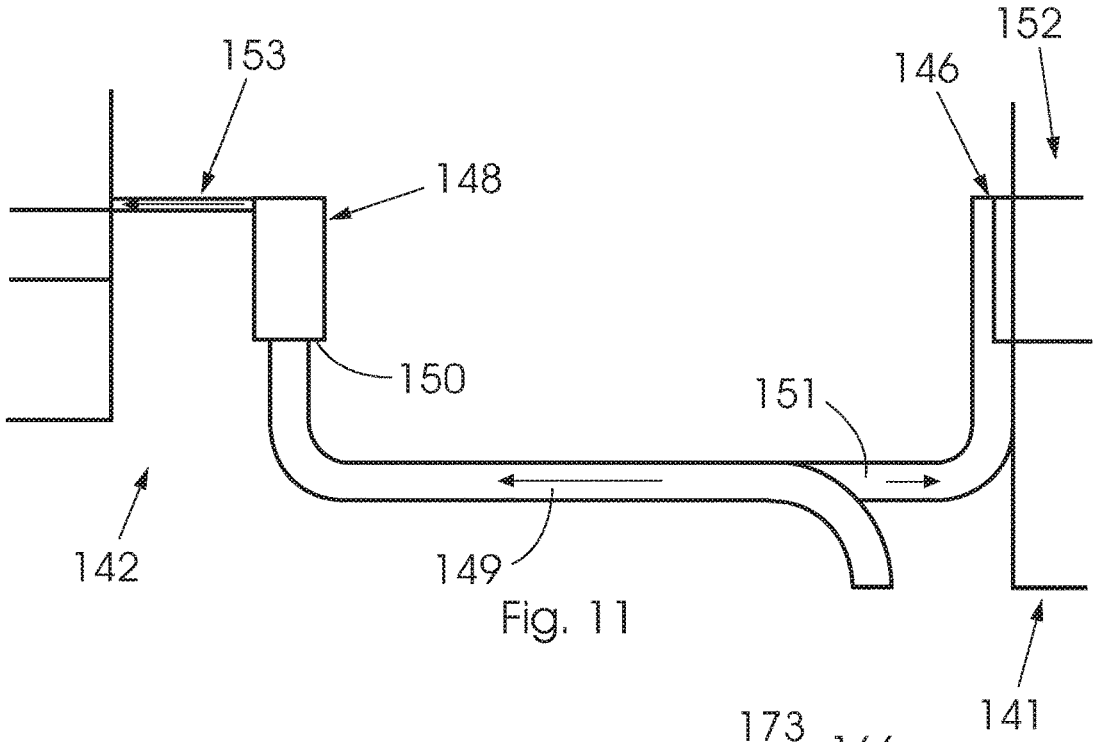
FIG. 11 is a sectional front elevation of part of the steelmaking apparatus of FIG. 9 showing detail of an alternative embodiment for the connection between the iron making furnace and the refining furnace.

As shown with the sixth embodiment of a steelmaking apparatus (140) in FIGS. 9 to 11, it is possible to arrange an iron making furnace (141) and a refining furnace (142) in this type of configuration in a straight line, with liquid iron being transferred through a tea-pot arrangement transfer system (143) from the iron-making furnace (141) to the refining furnace (142).

In this embodiment (140) the iron making furnace is provided with five double loop induction heaters (144A-E) and one single loop induction heater (145). The single loop induction heater (145) includes a fore-hearth (148) similar to that described in the third embodiment shown in FIG. 5, with the difference that the induction heater is located at the end (146) of the iron making furnace, which locates the induction heater channel (147) beside the end (146) of the furnace (141).

The fore-hearth (148) is fed with heated liquid metal (in this instance liquid iron), from the induction heater channel (147) through a conduit (149) which flows into the base (150) of the fore-hearth (148). The fore-hearth (148) is also provided with an outlet (151) which flows out of its base (150) to below the end of the furnace wall (146) to feed into the furnace hearth (152). In this manner, substantially slag free heated liquid iron is passed from the induction heater (145) through the fore-hearth (148) to the iron making furnace hearth (152).

The fore-hearth (148) also includes proximate its top an overflow passage (153) which connects the fore-hearth (148) with the refining furnace (142). In this embodiment the fore-hearth (148) if connected at a right angle of the side (146) of the iron making furnace (141) and it connects through the overflow passage (153) at a right angle to the refining furnace (142). This aligns the iron-making furnace (141) and refining furnace (142) in a straight line. Of course, it is possible to change this straight line to an angled connection, by changing the angle at which the fore-hearth is connected to either of the iron making furnace (141) or the refining furnace (142).

More importantly, the configuration means the fore-hearth (148) receives and contains substantially slag free and recently heated liquid iron from the single loop induction heater (145). This means the liquid iron is clean and its temperature is very stable, which provides a high quality stable input to the refining furnace (142).

General

Figure 12:
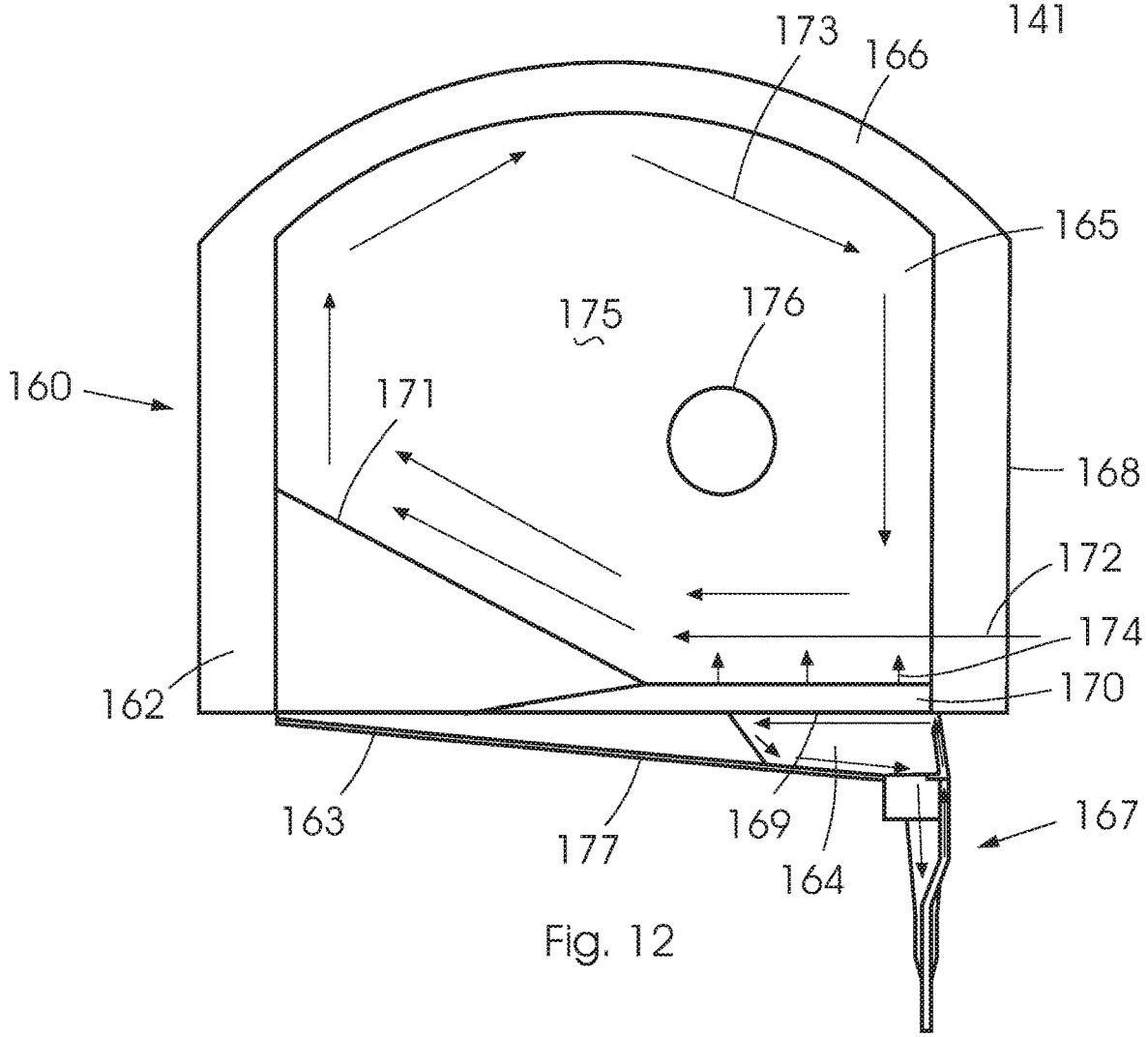
FIG. 12 is a sectional end elevation of the furnace of FIG. 1 and also showing its roof when used as a refining furnace, showing gas distribution therein and the width of the liquid metal bath not covered by feed material.

A final aspect of the invention is shown in FIG. 12, which shows a sectional end view of a furnace (160) according to the first embodiment of the invention, shown in FIGS. 1 and 2, when used as a refining furnace.

Feed material (161) will be charged from the side of the rear wall (162) onto the inclined floor (163) and will be partly supported by it and partly float on the surface of the liquid metal bath (164). In the case of a refining furnace, there is a wide portion of the liquid metal bath that is not covered by feed material. The floor (163) is operatively shielded by a protective skull (177) which forms onto it.

The upper surface of the charged material is exposed to a "combustion chamber" (165) formed below the roof (166) of the furnace (160), thereby reducing the electrical energy required for heating, chemical reactions and melting.

The series of spaced apart induction heaters (167) along the front wall (168) makes the front wall (168) effectively the "warm wall", and this prevents material (161) that have been charged to the furnace (160) from the rear wall (162) side from creating a bridge between the rear wall (162) and front wall (168), which is to be avoided to prevent unstable operating conditions from developing.

The solid feed (161) consists of ore fines, fluxes and a small amount of coal to reduce the $Fe_2O_3$ and $Fe_3O_4$ to mainly FeO. Heat generated by the combustion of carbon monoxide (CO) formed at the metal-slag interface (169) bubbles (174) through the slag (170), and this is used to help drive the endothermic decarburization reaction and to melt the FeO rich slag at the surface (171) of the heap of material. The molten FeO rich slag flows down the surface (171) of the heap to join the layer of slag (170) on the metal surface (169).

Hot air and oxygen (172) is pumped into the furnace (160) across the surface of the slag layer (170), to flow up over the surface (171) of the material supported on the inclined floor (163).

Spent gas (173) circulate around the interior of the combustion chamber (165), and joins the hot air and oxygen (172) and CO (174) to moderate the flame temperature and prevent formation of NOx. The spent gas, also known as off-gas, ultimately finds its way in a circulating/corkscrew along the length of the furnace (160) to exhaust openings (176) in the end-walls (175). The off-gas is passed through a heat exchanger (not shown) to heat the air used in the furnace (160).

As mentioned above, FIG. 12 relates to a refining furnace (160). If the furnace of the embodiment shown in FIGS. 1 and 2 is used for iron making the gas flow pattern is similar, but the distribution of the feed material in the hearth is different. As shown in FIGS. 7 and 9, the feed material (178, 179) in the iron making furnaces (111, 141) covers almost the entire liquid metal bath, leaving only a small portion of the bath uncovered (180, 181). This is in comparison with the much larger area of the liquid metal bath (182, 183) that is left uncovered in the refining furnaces (112, 142) by the feed material (184, 185).

The reason for this is that there is practically no gas evolution from the liquid metal surface in the iron making furnaces (111, 141), whereas there is significant gas evolution from the liquid metal surface in the refining furnaces (112, 142).

It will be appreciated that the embodiments described above are not intended to limit the scope of the invention, and it is possible to include changes to the embodiment without departing from the scope of the invention.

The invention claimed is:

1. A channel type induction furnace, comprising:

a shell lined with refractory material, the shell including a floor having a wall extending from the floor to form a hearth; and at least one induction heater associated with the channel type induction furnace and communicating with the hearth by a throat in the floor, the throat including throat passages having a down-passage serving as an inlet to the at least one induction heater and at least one up-passage serving as an outlet from the at least one induction heater, the throat passages complementary shaped and configured to channels in the channel type induction heater and each of the throat passages in fluid communication with a complimentary shaped and sized channel;

wherein the furnace floor is inclined downwards from an operative rear of the hearth towards an opposing operative front of the hearth;

wherein the wall at the front of the hearth includes a bottom section and a top section to form a front wall, with the front wall bottom section extending further into the hearth than the front wall top section, and the front wall bottom section terminating in an upper edge in abutment with the front wall top section;

wherein the down-passage includes an inlet in the floor at a location proximate the base of the front wall;

wherein at least one of the up-passages having an outlet in the floor at a location in abutment with the base of the front wall bottom section and with the front wall bottom section being provided with a vertical slot extending upwards above the at least one of the up-passages through it and opening onto the upper edge of the bottom section; and wherein the induction heater is located proximate the front wall.

2. The channel type induction furnace of claim 1 wherein the floor is provided with a pit proximate to the base of the front wall bottom section and the inlet for the down-passage is located in the pit.

3. The channel type induction furnace of claim 2 wherein the wall includes the front wall, an opposing rear wall forming the rear of the hearth, and two opposing end walls;

with an end wall extending between each of opposing ends of the front wall and the rear wall.

4. The channel type induction furnace of claim 1, which comprises a double loop channel type induction furnace with a throat thereof including a central down-passage serving as an inlet to the induction heater and two up-passages on opposite sides of the central down-passage serving as outlets from the induction heater; and wherein the two outlets from the up-passages are spaced apart.

5. The channel type induction furnace of claim 1 wherein the front wall is inclined into the hearth.

6. The channel type induction furnace of claim 5 wherein the front wall is inclined into the hearth by between about 0° and about 10° from the vertical.

7. The channel type induction furnace of claim 1 wherein the furnace floor includes a substantially horizontal floor base proximate to the front wall bottom section, with the inlet to the central passage being located in the floor base.

8. The channel type induction furnace of claim 1, further comprising a fore-hearth separate from the furnace hearth, the fore-hearth comprising a shell lined with refractory material, and having a floor with a wall extending from the floor to form the fore-hearth;

wherein the fore-hearth communicates with the induction heater up-passage by passages opening into it in its floor;

wherein the fore-hearth passages includes a down-passage serving as an outlet and an up-passage serving as an inlet to the fore-hearth from the at least one induction heater up-passage operatively to receive substantially slag-free metal from the induction heater;

wherein the fore-hearth passages are complementary shaped and configured to the channels in the induction heater; and wherein the fore-hearth includes a liquid metal overflow plug.

9. The channel type induction furnace of claim 8 wherein the fore-hearth includes a set of fore-hearth passages, with each set comprising a down-passage serving as an outlet and an up-passage serving as an inlet to the fore-hearth, with each set of fore-hearth passages being in fluid communication with an induction heater up-passage.

10. The channel type induction furnace of claim 1, further comprising:

an elongate fore-hearth separate from and extending away from the furnace hearth, the fore-hearth including a shell lined with refractory material, and having a floor with a wall extending from the floor to form the fore-hearth;

wherein the fore-hearth communicates with the induction heater up-passage by means of at least one passage opening into it in its floor at a location distal from the furnace hearth, wherein the fore-hearth communicates with the furnace hearth by a portal extending through the furnace front wall, above the upper edge of the front wall bottom section;

wherein the fore-hearth including an overflow outlet, at a point distal from the furnace hearth;

operatively for heated metal to flow into the fore-hearth at the inlet distal from the furnace hearth and from the fore-hearth into the furnace through the portal, and for slag to flow from the furnace hearth into the fore-hearth through the portal counter current with the heated liquid metal, to allow metal droplets contained in the slag to pass through the slag into the flow of heated metal beneath the slag, and for slag to be removed from the fore-hearth through the slag outlet.

11. A method of operating a channel type induction furnace to produce liquid metal, the channel type induction furnace including a shell lined with refractory material, the shell including a floor having a wall extending from the floor to form a hearth; and at least one induction heater associated with the channel type induction furnace and communicating with the hearth by a throat in the floor, the throat including throat passages having a down-passage serving as an inlet to the at least one induction heater and at least one up-passage serving as an outlet from the at least one induction heater, the throat passages complementary shaped and configured to channels in the channel type induction heater and each of the throat passages in fluid communication with a complimentary shaped and sized channel; wherein the furnace floor is inclined downwards from an operative rear of the hearth towards an opposing operative front of the hearth; wherein the wall at the front of the hearth includes a bottom section and a top section to form a front wall, with the front wall bottom section extending further into the hearth than the front wall top section, and the front wall bottom section terminating in an upper edge in abutment with the front wall top section; wherein the down-passage includes an inlet in the floor at a location proximate the base of the front wall; wherein at least one of the up-passages having an outlet in the floor at a location in abutment with the base of the front wall bottom section and with the front wall bottom section being provided with a vertical slot extending upwards above the at least one of the up-passages through it and opening onto the upper edge of the bottom section; and wherein the induction heater is located proximate the front wall, the method comprising:

preparing a feed material comprising a metallic oxide and a reductant;

charging the feed material into the furnace onto the inclined furnace floor proximate a rear wall at an operative rear of the hearth; and operatively allowing the feed material to accumulate on the floor and to extend into the liquid metal bath, to undergo carbo-thermic reduction through radiation from heat of combustion of gases, for the feed material to melt and join the liquid metal bath, with the gases originating from heating of the feed material and optionally also from fuel, preferably gas, introduced into free space above the liquid metal bath and feed material.

12. The method of claim 11, further comprising introducing fuel into the free space above the liquid metal bath and feed material to combust and generate heat for reduction of the feed material.

13. A steelmaking apparatus, comprising:

an iron furnace; and a refining furnace;

wherein the iron furnace includes a channel type induction furnace provided with a liquid iron transfer conduit extending from the iron furnace fore-hearth to the refining furnace, to produce liquid iron from an iron containing feed material, contain the liquid iron as a pool in the iron furnace hearth, and to transfer slag-free liquid iron from the pool to the refining furnace by means of the liquid iron transfer conduit; and wherein the channel type induction furnace of the iron furnace includes a shell lined with refractory material, the shell including a floor having a wall extending from the floor to form a hearth; and at least one induction heater associated with the channel type induction furnace and communicating with the hearth by a throat in the floor, the throat including throat passages having a down-passage serving as an inlet to the at least one induction heater and at least one up-passage serving as an outlet from the at least one induction heater, the throat passages complementary shaped and configured to channels in the channel type induction heater and each of the throat passages in fluid communication with a complimentary shaped and sized channel; wherein the furnace floor is inclined downwards from an operative rear of the hearth towards an opposing operative front of the hearth; wherein the wall at the front of the hearth includes a bottom section and a top section to form a front wall, with the front wall bottom section extending further into the hearth than the front wall top section, and the front wall bottom section terminating in an upper edge in abutment with the front wall top section; wherein the down-passage includes an inlet in the floor at a location proximate the base of the front wall; wherein at least one of the up-passages having an outlet in the floor at a location in abutment with the base of the front wall bottom section and with the front wall bottom section being provided with a vertical slot extending upwards above the at least one of the up-passages through it and opening onto the upper edge of the bottom section; and wherein the induction heater is located proximate the front wall; a fore-hearth separate from the furnace hearth, the fore-hearth comprising a shell lined with refractory material, and having a floor with a wall extending from the floor to form the fore-hearth; wherein the fore-hearth communicates with the induction heater up-passage by passages opening into it in its floor; wherein the fore-hearth passages includes a down-passage serving as an outlet and an up-passage serving as an inlet to the fore-hearth from the at least one induction heater up-passage operatively to receive substantially slag-free metal from the induction heater; wherein the fore-hearth passages is complementary shaped and configured to the channels in the induction heater; and wherein the fore-hearth including a liquid metal overflow plug;

wherein the refining furnace including a channel type induction furnace in fluid communication with the iron furnace fore-hearth through the liquid iron transfer conduit to receive liquid iron from the iron furnace fore-hearth, to convert the liquid iron to liquid steel and contain the liquid steel as a pool in the refining furnace hearth, and to transfer slag-free liquid steel from the liquid steel pool to the alloying container by a liquid steel transfer conduit, and the refining furnace being provided with a closable outlet to tap liquid steel from the refining furnace;

wherein the channel type induction furnace of the refining furnace includes a shell lined with refractory material, the shell including a floor having a wall extending from the floor to form a hearth; and at least one induction heater associated with the channel type induction furnace and communicating with the hearth by a throat in the floor, the throat including throat passages having a down-passage serving as an inlet to the at least one induction heater and at least one up-passage serving as an outlet from the at least one induction heater, the throat passages complementary shaped and configured to channels in the channel type induction heater and each of the throat passages in fluid communication with a complimentary shaped and sized channel; wherein the furnace floor is inclined downwards from an operative rear of the hearth towards an opposing operative front of the hearth; wherein the wall at the front of the hearth includes a bottom section and a top section to form a front wall, with the front wall bottom section extending further into the hearth than the front wall top section, and the front wall bottom section terminating in an upper edge in abutment with the front wall top section; wherein the down-passage includes an inlet in the floor at a location proximate the base of the front wall; wherein at least one of the up-passages having an outlet in the floor at a location in abutment with the base of the front wall bottom section and with the front wall bottom section being provided with a vertical slot extending upwards above the at least one of the up-passages through it and opening onto the upper edge of the bottom section; and wherein the induction heater is located proximate the front wall.

14. The steelmaking apparatus of claim 13, further comprising:

an alloying chamber; and a casting machine tundish;

wherein the alloying chamber is provided with heating means for liquid steel to receive liquid steel from the outlet of the refining furnace and contain and heat the liquid steel as a pool in the alloying chamber, and the alloying chamber including means for the addition of alloying elements, and the alloying chamber further being configured to transfer slag-free liquid steel to the tundish by means of a tundish transfer conduit extending from beneath the operative slag level of the alloying chamber to the tundish; and wherein the tundish is configured to receive liquid steel from the alloying container through the tundish transfer conduit to feed a casting machine operatively associated with the tundish by means of a casting outlet; and wherein the steelmaking apparatus including control means for the liquid iron and liquid steel levels in the furnaces in the form of one or more of casting speed control for the tundish, at least one liquid iron tap hole from the iron furnace.

15. The steelmaking apparatus of claim 14, wherein the alloying chamber includes the channel type induction furnace, and the alloying chamber includes stirring means for the liquid steel;

wherein the channel type induction furnace of the alloying chamber includes a shell lined with refractory material, the shell including a floor having a wall extending from the floor to form a hearth; and at least one induction heater associated with the channel type induction furnace and communicating with the hearth by a throat in the floor, the throat including throat passages having a down-passage serving as an inlet to the at least one induction heater and at least one up-passage serving as an outlet from the at least one induction heater, the throat passages complementary shaped and configured to channels in the channel type induction heater and each of the throat passages in fluid communication with a complimentary shaped and sized channel; wherein the furnace floor is inclined downwards from an operative rear of the hearth towards an opposing operative front of the hearth; wherein the wall at the front of the hearth includes a bottom section and a top section to form a front wall, with the front wall bottom section extending further into the hearth than the front wall top section, and the front wall bottom section terminating in an upper edge in abutment with the front wall top section; wherein the down-passage includes an inlet in the floor at a location proximate the base of the front wall; wherein at least one of the up-passages having an outlet in the floor at a location in abutment with the base of the front wall bottom section and with the front wall bottom section being provided with a vertical slot extending upwards above the at least one of the up-passages through it and opening onto the upper edge of the bottom section; and wherein the induction heater is located proximate the front wall.

16. The steelmaking apparatus of claim 13 wherein the refining furnace includes a charging hole for scrap steel or iron.

* * * * *